United States Patent [19]

Gillette

[11] 4,065,881

[45] Jan. 3, 1978

[54] GUIDED HONING TOOL

[76] Inventor: Robert H. Gillette, Box 313, Angola, Ind. 46703

[21] Appl. No.: 747,820

[22] Filed: Dec. 6, 1976

[51] Int. Cl.[2] ..... B24B 33/08

[52] U.S. Cl. ..... 51/346; 51/344

[58] Field of Search ..... 51/331, 338–354

[56] References Cited

U.S. PATENT DOCUMENTS

| | | | |
|---|---|---|---|
| 2,263,781 | 11/1941 | Kline | 51/342 |
| 2,581,601 | 1/1952 | Peden | 51/338 |
| 2,790,278 | 4/1957 | Smith | 51/346 |
| 3,123,945 | 3/1964 | Engle | 51/338 |
| 3,507,077 | 4/1970 | Massig | 51/338 |
| 3,861,091 | 1/1975 | McDonald | 51/331 |

*Primary Examiner*—Harold D. Whitehead
*Assistant Examiner*—Nicholas P. Godici
*Attorney, Agent, or Firm*—Gust, Irish, Jeffers & Rickert

[57] ABSTRACT

A generally cylindrical honing tool for internally honing a workpiece which may have an interrupted bore is disclosed having a plurality of radially disposed axially extending tool supported thermoplastic guide members for engaging the workpiece at a first relatively constant pressure to aid in aligning the tool with the workpiece and having a plurality of radially disposed axially extending tool supported abrasive elements for engaging the workpiece at a pressure which is variable and independent of the guide pressure for abrading material from the workpiece.

13 Claims, 3 Drawing Figures

GUIDED HONING TOOL

BACKGROUND OF THE INVENTION

The present invention relates gnerally to honing tools and more especially to honing tools employing both abrading and guiding elements urged into contact with a workpiece independent of one another.

Honing is a process where through numerous reciprocating and rotating passes, a relatively small amount of material is removed from a surface by means of abrasive elements. The abrading action occurs over a wide surface area rather than on a line of contact as in a grinding operation. The honing tool itself comprises a holding device or body of generally cylindrical configuration containing several generally oblong abrasive elements arranged in a circular pattern in which abrasive elements are forced against a workpiece by a wedging action, for example, of expander plates, forcing those abrasive elements radially outwardly. Such reciprocable and rotatable honing tools carrying such circumferentially spaced abrasive elements or honing stones have been utilzed for many years to hone cylindrical bores in workpieces, such as, for example, the cylindrical bores for internal combustion engines.

It has been proposed, for example, in U.S. Pat. No. 3,861,091, to avoid wearing of the honing tool body by providing fixed guide elements attached to that body, which approach, while it may avoid body wear, does require that the abrasive members and guide members be replaced frequently.

It has also been proposed, for example, in the honing of interrupted bores, such as might be encountered in hydraulic valve bodies, to provide tool guides disposed about the periphery of the tool in much the same manner as the abrasive elements, which tool guides are urged simultaneously with the abrasive elements into contact with the workpiece to maintain tool alignment relative to that workpiece. With such a proposed system, overcutting problems of thin sections of such an interrupted bore are diminished, however, the abrasive elements and guides are forced to wear at substantially the same rate necessitating the replacement of the guides each time the abrasive elements are replaced. Such replacement adds materially to the cost of the honing operation.

SUMMARY OF THE INVENTION

Among the several objects of the present invention may be noted the provision of a generally improved honing tool characterized by reduced maintenance and reduced consumption of expendables; the provision of a a honing tool having improved stability; the provision of a honing tool of the guided type which experiences reduced wear and therefore reduced frequency of replacement of the hone guides or shoes; and the provision of a system for honing an interrupted bore to improved tolerances.

The foregoing as well as numerous other objects, features and advantages of the present invention are achieved by providing a generally cylindrical tool for internally honing a workpiece having guides disposed about the tool for engaging the workpiece at a first relatively constant pressure to aid in aligning the tool with the workpiece, and having abrasive elements disposed about the tool for engaging the workpiece at a second pressure which is variable and independent of the guide pressure for abrading material from the workpiece. The guides may be spring biased radially outwardly toward the workpiece and the abrasive elements urged radially outwardly toward that workpiece by actuation of a movable control rod which wedgingly engages the abrasive elements.

Also in general and in one form of the invention, a honing tool has a generally cylindrical body provided with plural, longitudinally extending, outwardly opening radial slots with a first subplurality of those slots carrying abrasive elements and a second subplurality of those slots carrying guide elements with first means selectively urging expander plates and therefore also the abrasive elements radially outwardly into engagement with a workpiece and second means operable independently of the firstmentioned selectively urging means for forcing the guide elements into engagement with the workpiece.

BRIEF DESCRIPTION OF THE DRAWING

Corresponding reference characters indicate corresponding parts thorughout the drawing and the following examples illustrate the invention in one form but are not to be construed as limiting in any manner.

DESCRIPTION OF THE PREFERRED EMBODIMENT

Figure 2:
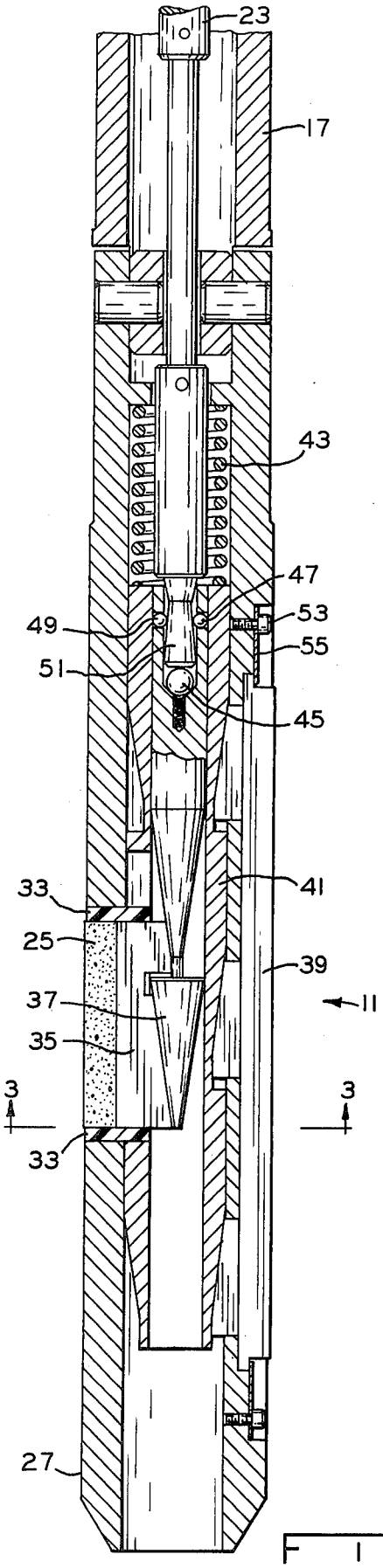
FIG. 2 is a longitudinal section view of the honing tool of FIG. 1.
Figure 1:
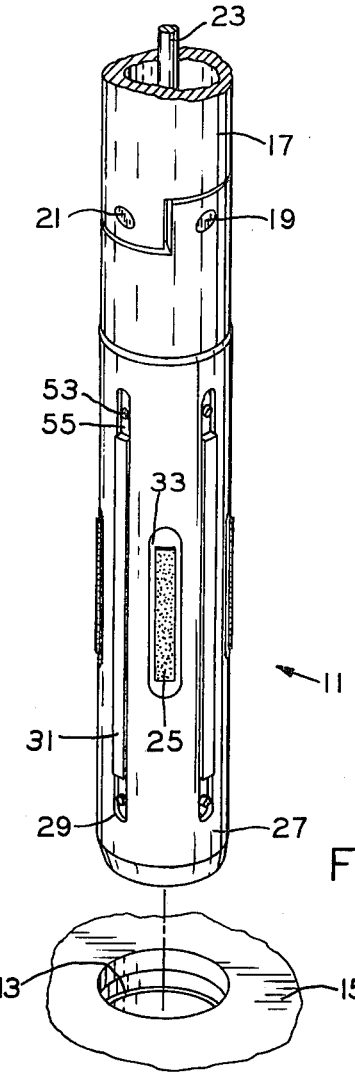
FIG. 1 is a perspective view of a honing tool incorporating one form of the invention, and aligned with a prospective workpiece.
Figure 3:
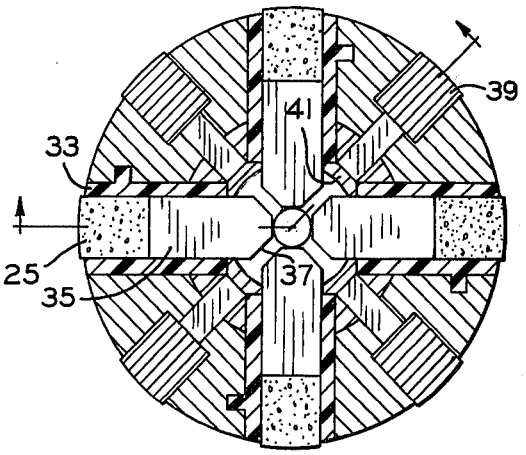
FIG. 3 is a sectional view of the honing tool of FIG. 2 along the line 3—3.

Referring now to the drawing in greater detail, there is indicated generally at 11, a honing tool, which is completely compatabile with existing honing machinery, yet incorporates the advantageous features of the present invention. The honing tool 11 is illustrated as about to enter an interrupted bore 13 of a workpiece 15 for a honing operation. The honing tool would be driven in a reciprocatory and rotary manner by drive shaft 17 by way of a universal joint 19, 21, and a control rod 23 would be actuated by the standard honing machine to force abrasive elements such as 25 into contact with the bore 13.

In greater detail, the honing tool 11 has a generally cylindrical body portion 27 with a plurality of longitudinally extending outwardly opening radial slots such as 29 for accepting abrasive elements such as 25, as well as guiding elements such as 31. As illustrated, there are eight such slots, four of which accept abrasive elements and four of which accept guiding elements.

An abrasive element such as 25 is disposed in a slot liner, and abrasive retainer such as 33, which may be constructed of Nylon according to the teachings of my U.S. Patent application Ser. No. 575,149, entitled "Honing Tool Slot Liner and Abrasive Retainer" and now U.S. Pat. No. 3,995,400. The abrasive element 25 is urged outwardly by an expander plate such as 35, which in turn is in contact with a conical member 37, movable axially by the control rod 23 to extend radially outwardly the several abrasive elements such as 25.

The guide elements such as 31 or 39 are not, however, mechanically linked to the control rod 23 in the above-described manner, but rather these guides are forced radially outwardly by the axial movement of a second conical member 41, which is disposed within the tool coaxial with the first conical member 37, but which conical member 41 is urged in an axial direction by a coil spring 43.

In operation, assuming that all guides and abrasive elements are in their retracted position, the tool is inserted into an opening in a workpiece to be honed, and thereafter the control rod 23 is advanced relative to the drive shaft 17, which allows coil spring 43 to expand axially, and for a time both conical member 37 and conical member 41 move axially together. When guide 39 engages the interior surface to be honed, at a preferred pressure, as determined by spring 43, further movement of the control rod 23 advances only conical member 37, and depending upon the pressure applied to control rod 23, the resulting force as transmitted from the conical member 37 moving in the axial direction to the expander plate 35 moving in the radial direction. The abrasive element 25 may be forced against the workpiece with a desired selected pressure.

There is a lost motion coupling between the control rod 23 and the inner conical member 37 as determined by a spring loaded ball 45 and further there is a frictional coupling between the inner conical member 37 and the outer conical member 41 as determined by four annularly displaced balls 47 and 49, which are forced outwardly to frictionally engage the inner surface of the outer conical member 41 by a tapered plug 51 which forms one end of control rod 23. When the control rod 23 is retracted axially, tapered member 51 exerts a greater and greater force on the conical member 41, as conical member 37 moves relative to conical member 41. When this frictional force is sufficient to overcome the biasing of spring 43, the two coaxial members travel in unison to retract or allow the retraction of both the abrasive elements and the guide elements for a new honing operation. The guide members may be held in the tool and forced or biased to their retracted position upon withdrawal of the control rod by leaf springs 55 and cap screws 53. Thus, the interconnection illustrated allows but a single control rod 23 to retract both abrasive and guide elements, while at the same time allowing independent control of the pressure applied to the abrasive elements since the guide elements are urged outwardly at a substantially uniform pressure by the spring 43.

In the particular illustrated preferred embodiment of the present invention, the axial extent of the guide elements is substantially greater than the axial extent of the abrasive elements. Also, the abrasive elements are illustrated as being frictionally retained by a one piece bushing for each such abrasive element which is fixed to the body portion within a slot and extends radially to simultaneously girdle at least a portion of that abrasive element 25 and at least a portion of a pertaining expander plate 35, however, other abrasive element arrangements could be employed. In the illustrated preferred embodiment, both this bushing or slot liner 33 and the guide elements 39 are made from a thermoplastic material such as Nylon, however, other materials might be more suitable for specific honing operations.

These and numerous other modifications will readily suggest themselves to those of ordinary skill in the art and accordingly the scope of the present invention is to be measured only by that of the appended claims.

I claim:

1. A honing tool having a generally cylindrical body portion with a plurality of longitudinally extending outwardly opening radial slots, an abrasive element disposed in each of a first subplurality of said slots, a like first subplurality of expander plates each carried by the body and projecting radially outwardly with the outer end portions thereof being disposed in the slots and engaging respective abrasive elements, means for selectively urging all of the expander plates and therefore also the abrasive elements simultaneously radially outwardly and into engagement with a workpiece, guide means disposed in each of a second subplurality of said slots for engaging the workpiece and aligning the tool relative to the workpiece, means operable independently of the means for selectively urging for forcing the guide means into engagement with the workpiece, an axially movable control rod, a lost motion coupling between the control rod and the means for selectively urging, and means for selectively frictionally coupling the control rod and the means for forcing, the control rod being movable in a first direction to engage and actuate the means for selectively urging, and movable in a second direction to deactuate the means for selectively urging and to frictionally engage and override the means for forcing.

2. The honing tool of claim 1 wherein the abrasive elements and the guide means extend longitudinally along the tool body with the guide means extending longitudinally beyond the abrasive elements at each end thereof.

3. The honing tool of claim 1 wherein the means for forcing the guide means includes a spring.

4. The honing tool of claim 1 further comprising spring means for continuously biasing the guide means away from the workpiece.

5. The honing tool of claim 1 wherein the guide means comprises a like second subplurality of elongated thermoplastic members.

6. The honing tool of claim 5 wherein the thermoplastic material is Nylon.

7. The honing tool of claim 1 further comprising a bushing for each abrasive element fixed to the body portion within the slot and extending radially to simultaneously girdle at least a portion of the abrasive element and at least a portion of the pertaining expander plate.

8. The honing tool of claim 7 wherein each abrasive element is supported for radial movement relative to the bushing and is retained therein by frictional engagement between the abrasive element and the bushing.

9. The honing tool of claim 8 wherein each bushing comprises a one piece insert of thermoplastic material.

10. The honing tool of claim 9 wherein the thermoplastic material is Nylon.

11. In a generally cylindrical tool for internally honing a workpiece, first means disposed about the tool for engaging the workpiece at a first relatively constant pressure to aid in aligning the tool with the workpiece, second means disposed about the tool for engaging the workpiece at a second pressure which is variable and independent of the first pressure for abrading material from the workpiece, an axially movable control rod movable in one direction to urge the second means radially outwardly toward the workpiece and in the other direction to disable the first means, first and second coaxial conical members for converting axial movement of the respective conical members to radial motion of the first and second means, lost motion means coupling the control rod to the first conical member when the control rod is moved in the said one direction, and means including the lost motion means for frictionally connecting the first and second conical members together when the control rod is moved in the said other direction.

12. The tool of claim 11 wherein the first means comprises a plurality of elongated thermoplastic members each spring biased radially outwardly toward the workpiece.

13. The tool of claim 11 wherein the first means comprises a plurality of radially disposed axially extending tool supported thermoplastic guide members and the second means comprises a plurality of radially disposed axially extending tool supported abrasive elements.

* * * * *